US005453026A

United States Patent [19]

Ikegami

[11] Patent Number: 5,453,026

[45] Date of Patent: Sep. 26, 1995

[54] PLUG ASSEMBLY AND CONNECTOR

[75] Inventor: Kenji Ikegami, Hachioji, Japan

[73] Assignee: The Whitake Corporation, Wilmington, Del.

[21] Appl. No.: 228,069

[22] Filed: Apr. 15, 1994

[30] Foreign Application Priority Data

Jun. 25, 1993 [JP] Japan ..... 5-155283

[51] Int. Cl.[6] ..... H01R 9/07

[52] U.S. Cl. ..... 439/579; 439/98

[58] Field of Search ..... 439/578–585, 439/675, 92, 108, 607–610, 98

[56] References Cited

U.S. PATENT DOCUMENTS 4,917,616 4/1990 Demler, Jr. et al. ..... 439/579
4,988,312 1/1991 Suzuki et al. ..... 439/581
5,197,893 3/1993 Morlion et al. ..... 439/108
5,222,898 6/1993 Fedder et al. ..... 439/108

*Primary Examiner*—David L. Pirlot
*Attorney, Agent, or Firm*—Adrian J. LaRue; Timothy J. Aberle

[57] ABSTRACT

The plug assembly consists of roughly flat grounding plates (3) having grounding blades (3*a*) making contact with the outer conductor of a coaxial cable connector (17), a plug housing (1) containing the grounding plates and having openings at its matching surface intersecting with the grounding plates, and a cover housing (9) with openings for the insertion of the coaxial cable which also secures the grounding plates. The header assembly (15) consists of roughly flat grounding contacts (13) having a fork-shaped receptacle (13*a*). When the above assemblies are joined together, the receptacle contacts the grounding plates which are passed through the openings of the plug assembly. Since both the grounding plates and the grounding contacts are of a roughly flat configuration, their production is simple.

18 Claims, 4 Drawing Sheets

PLUG ASSEMBLY AND CONNECTOR

This invention relates to plug assemblies for the connection of coaxial cables, and to connectors having such plug assemblies, and to header assemblies intended for joining to the plug assemblies.

BACKGROUND OF THE ART

One of the types of cables used for transmission of high frequency signals is coaxial cable. A coaxial cable consists of a center conductor surrounded by an insulation layer over which an outer conductor is wound. Because of the outstanding noise resistance of coaxial cables due to the fact that the center conductor is shielded by the outer conductor, they are widely used in multiplex communications, television, and computers. Numerous methods of connection of such coaxial cables to mother boards were offered in the past (for example, JP Utility Model (1991)-131281 and Utility Model Disclosure (1993)-14867).

FIG. 4A is an oblique view of a contact of the connector proposed in the JP Utility Model (1990)-131281.

This contact 50 consists of primary contact blades 50*a* which contact the outer conductor 53 of the coaxial cable (see FIG. 4B) and a secondary contact 50*b* connected to this primary contact 50*a* and to the ground pin 60 (see FIG. 4C). The contact 50 also has supporting blades 50*c* inserted in a guiding plate 54 (see FIGS. 4A and C). The essential elements of this contact 50 are made of two sheets of a conductive material. The contacts 50 are used in a parallel array.

FIG. 4B is a cross section of the above electrical connector at the location of the primary contact.

Supporting blades 50*c* of the contact 50 are inserted and secured in the groove made in the guiding plate 54. The coaxial cable connector 52 is inserted in the opening 58*a* of the retainer 58, and the outer conductor 52*a* of the tip of the coaxial cable connector 52 comes in contact with the primary contacting blades 50*a* of the contact 50, thus securing the coaxial cable connector 52 in the primary contact blades 50*a*. At the same time, the center conductor (not shown in the drawing) of the coaxial cable connector 52 comes into contact with the signal pin 56 of the mother board (not shown in the drawing).

Since the center conductor of the coaxial cable connector 52 comes into contact with the signal pin 56, the signal carried by this center conductor is transmitted to the board via the signal pin 56.

FIG. 4C is a cross section of the above electrical connector at the location of the secondary contact blade.

The ground pin 60 extending from the guiding plate 54 is sandwiched between two adjacent secondary contact blades 50*b*.

The ground pin 60 comes into contact with the secondary contact 50*b* which is connected to the primary contact blade 50*a*. Because of that the outer conductor 52*a* of the coaxial cable connector 52 becomes connected to the board through primary and secondary contact blades 50*a* and 50*b*.

FIG. 5 is a cross section showing an electrical connector described in the JP Utility Model Disclosure (1992)-14867. The elements similar to those depicted in the FIG. 4 will be assigned the same numbers.

This electrical connector has the same contacts as the connector 50 shown in FIG. 4A. The primary contact blade 50*a* of this contact secures the coaxial cable connector 52.

The signal pin 56 extending from the mother board (not shown in the drawing) comes into contact with the center wire of the coaxial cable connector 52, and the outer conductor of this connector 52 comes into contact with the primary contact blade 50*a*. As shown in FIGS. 4A and C, this contact also has a secondary contact blade connected to the primary contact blade 50*a*.

Since the contacts 50 in the electrical connectors described in the above disclosures are formed by two conducting plates joined together, there is always a possibility that one blade will shift relative to the other, thus making the assembly inside the housing more difficult. In addition, in the known contact 50, the primary contact blade 50*a*, which forms contact with the center wire of the coaxial cable 52, and the secondary contact blade 50*b*, which forms contact with the outer conductor of the coaxial cable 52, are formed close to each other, creating certain difficulties in the manufacturing process.

This invention has the purpose to correct this situation, and to offer a plug assembly and connector for coaxial cables which make it possible to easily produce and assemble these elements.

SUMMARY OF THE INVENTION

In order to achieve the above stated purpose, the plug assembly according to the instant invention is characterized by the fact that it consists of a flat grounding plate having contacting blades forming contact with the outer conductor of the connectors terminating coaxial cables, a plug housing accommodating said grounding plate and having, at its matching surface, holes intersecting the above-mentioned grounding plate, and a cover housing attached to said plug housing which has at its one end openings for the insertion of the above-mentioned connectors and secures said grounding plate inside the housing.

In order to achieve the above stated purpose, the connector according to the instant invention consists of a header assembly having roughly flat grounding contacts with a fork-shaped receptacle, a header housing containing the grounding contacts, a plug assembly containing a flat grounding plate having contact blades forming contact with the outer conductor of the connectors terminating the coaxial cables, a plug housing containing this grounding plate and having, at its matching surface, holes intersecting with the above-mentioned grounding plate, and a cover housing attached to said plug housing which has at its one end openings for the insertion of the connectors, and secures said grounding plate inside the housing, characterized by the fact that at the time of joining the above-mentioned header assembly and plug assembly, the fork-shaped receptacle makes contact with the portion of the grounding plate other than the contacting blades when it is inserted in the openings made in the plug assembly.

The plug assembly according to the instant invention consists of a roughly flat grounding plate having a contacting blade which forms contact with the outer conductor of the coaxial cable contained in a plug housing, thus facilitating its assembly process.

The connector according to the instant invention consists of a header assembly having a roughly flat grounding contact with a fork-shaped receptacle contained in a header housing which can be matched with the plug assembly, thus facilitating its assembly process.

The grounding contact and the grounding plate used in the devices according to this invention are both made in a roughly flat configuration and are therefore easy in manufacture.

BRIEF DESCRIPTION DRAWINGS

DETAILED DESCRIPTION OF THE INVENTION

Figure 1:
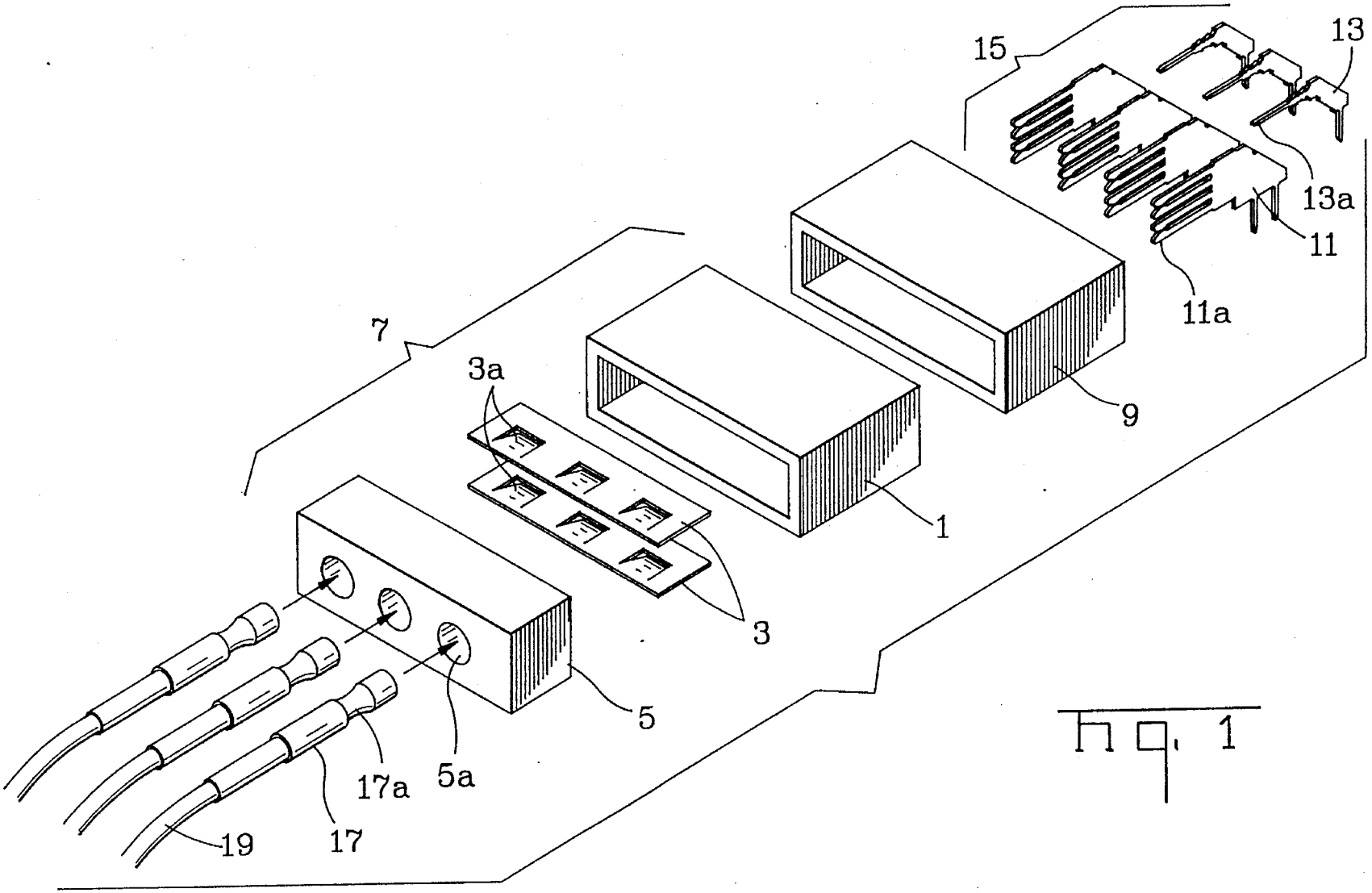
FIG. 1 is a schematic diagram showing an embodiment of the connector according to the instant invention.

FIG. 1 is a schematic diagram of an embodiment of a connector according to this invention. This connector consists of a plug assembly 7 and a header assembly 15.

As shown in FIG. 1, flat grounding plates 3 are provided at the upper and lower inner walls of the plug housing 1 of this plug assembly 7, which have protruding contacting blades 3*a* making contact with the outer conductors of the connectors 17 attached to the ends of coaxial cables 19. These contacting blades 3*a* snap into recesses 17*a* made in the connectors 17. The cover housing 5 of the plug assembly 7 closes the left (as seen in FIG. 1) opening of the plug housing 1, thus locking the grounding plates 3 in place. The cover housing 5 also has openings 5*a* for the insertion of the above mentioned connectors 17. The header housing 9 of the header assembly 15 contains fork-shaped receptacles 11*a* with roughly flat grounding contacts 11 and signal contacts 13 having a male-type contacting tip 13*a*.

Since the grounding plates 3 are located along upper and lower walls of the plug housing 1 of the plug assembly 7, its assembly operation does not represent any difficulty. Assembly of the header assembly 15 is also simple, since it involves only flat grounding contacts and signal contacts 13 contained in the header housing 9. The grounding plates 3, grounding contacts 11, and signal contacts 13 are roughly flat elements made by stamping and pressing from a metal sheet (not shown in the drawing) which is a simple manufacturing operation guaranteeing high dimensional precision.

Figure 2:
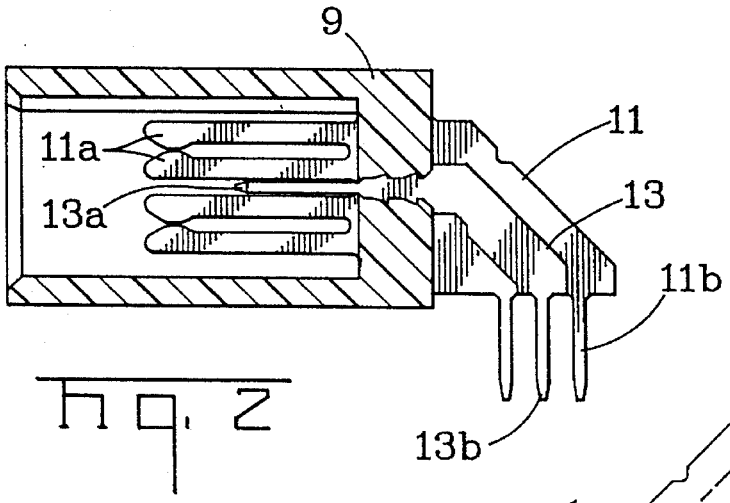
FIG. 2 is a cross section of the header assembly according to the instant invention.

FIG. 2 is a cross section of the header assembly. The grounding contacts 11 and the signal contacts 13 are inserted in the header housing 9 from its right side as seen in FIG. 2. The grounding contacts 11 contact with the grounding plates 3, and the signal contacts 13 are inserted inside the connector 17 attached to the end of the coaxial cable 19 forming contact with the center contact (not shown in the drawing) of the connector 17 (see FIG. 3). These grounding contacts 11 and signal contacts 13 are inserted in the header housing 9 in an intermittent pattern. The connecting portions 11*b* of the grounding contacts 11 and the connecting portions 13*b* of the signal contacts 13 are inserted into through holes (not shown in the drawing) and secured by soldering or some other method. They also may be attached using SMT (surface mounting technology).

Figure 3:
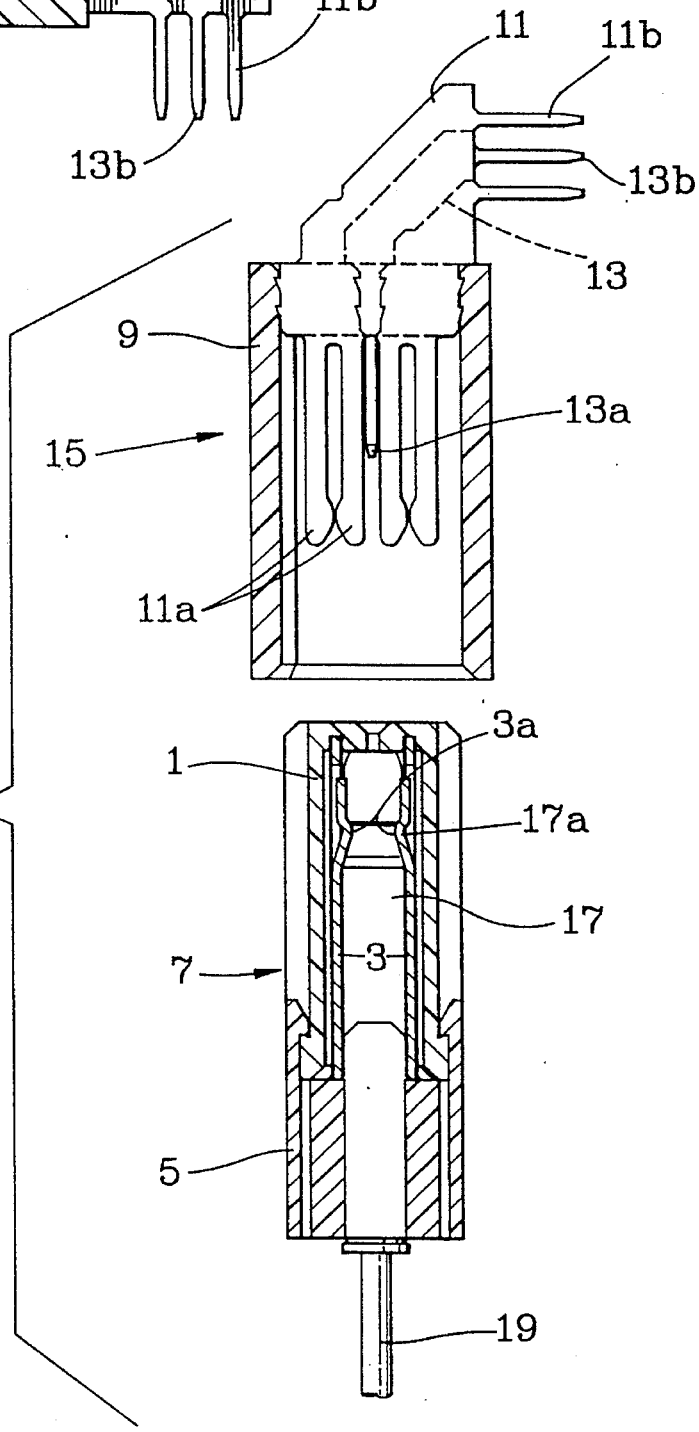
FIG. 3 is a cross section of the plug assembly and the header assembly according to the instant invention.
Figure 4A:
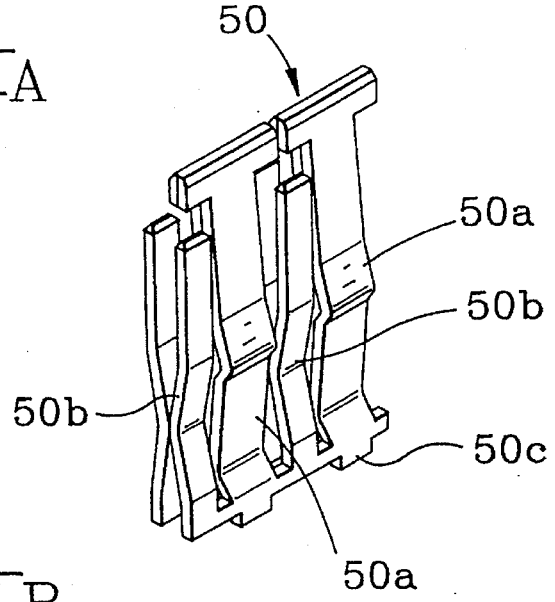
FIGS. 4A–4C is a cross section of an example of a conventional electrical connector.
Figure 4B:
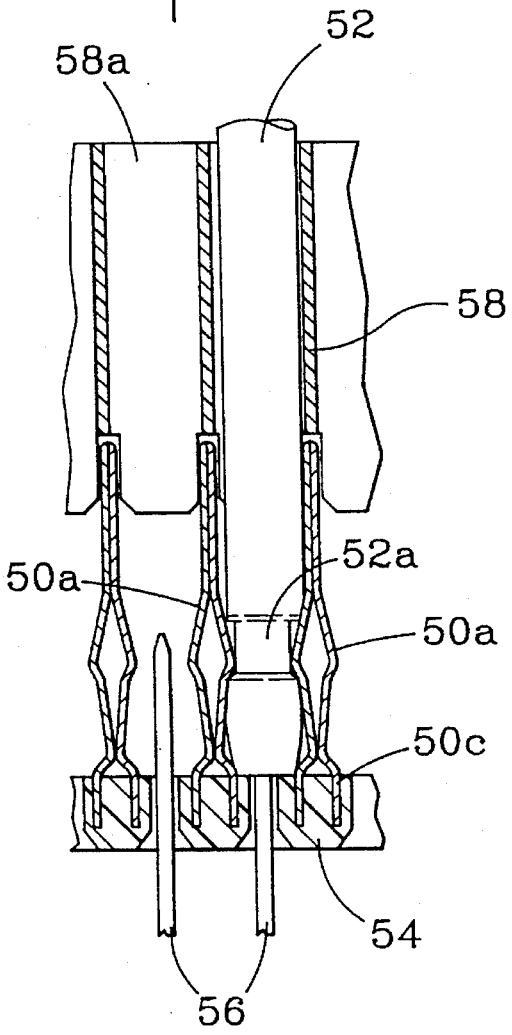
Figure 4C:
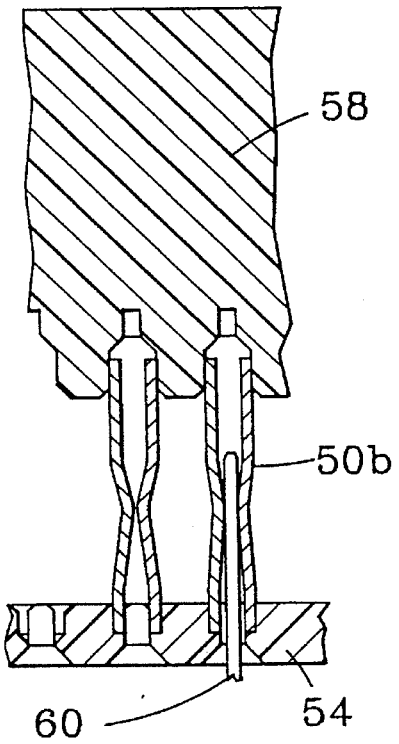
Figure 5:
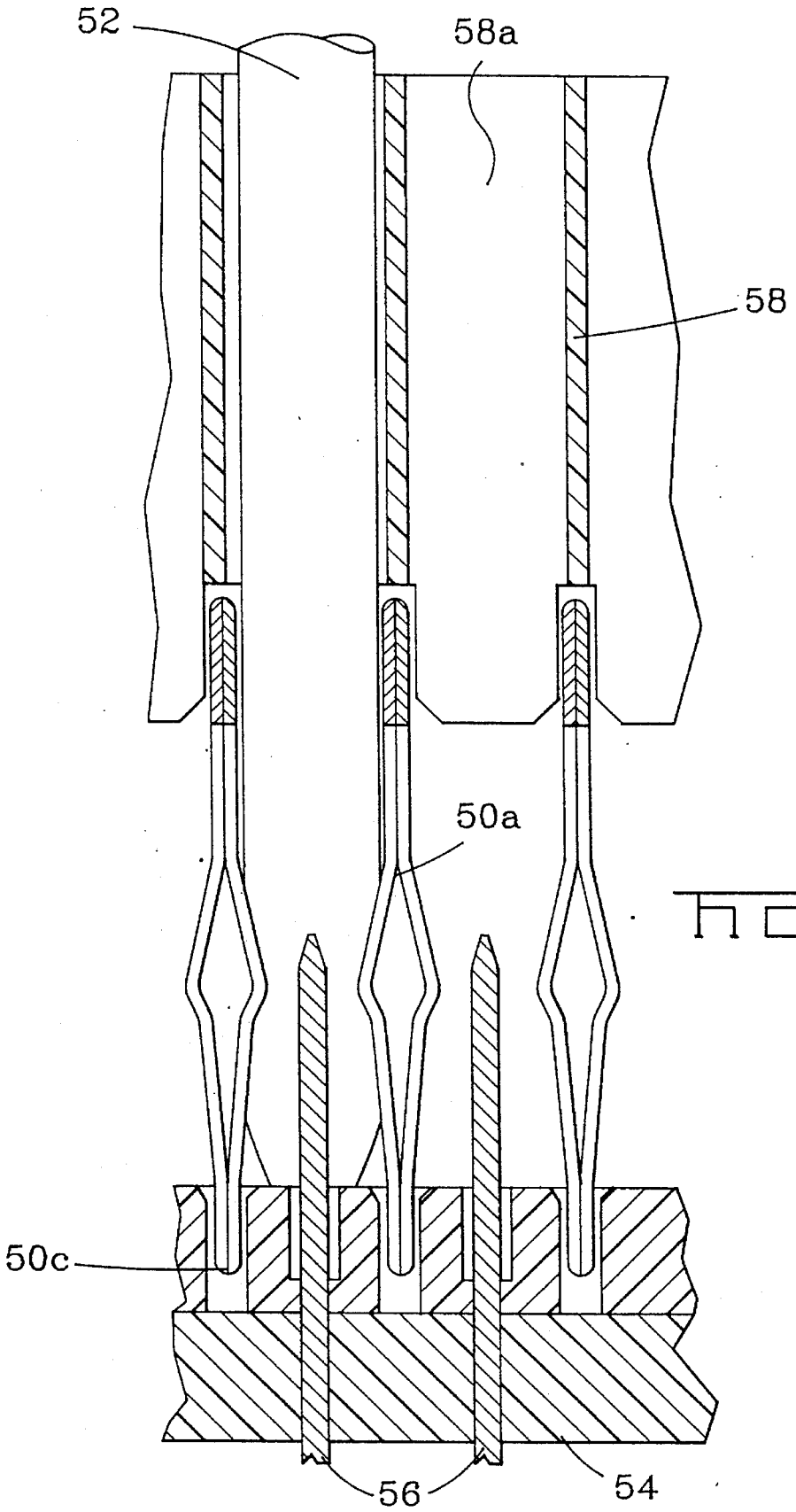
FIG. 5 is another known connector.

FIG. 3 is a cross section of the plug assembly and the header assembly with the connector attached to the end of the coaxial cable inserted therein. The connector 17 attached to the end of the coaxial cable 19 is inserted in the opening 5*a* (see FIG. 1) of the cover housing 5. The outer conductor of connector 17 is sandwiched from the top and the bottom (as seen in FIG. 3) by the grounding plates 3, 3, thereby forming contact with the grounding plates 3, 3. The contacting blades 3*a* of the grounding plates 3 snap into the recess 17*a* of the connector 17, securing connector 17 in the plug assembly 7. When the plug assembly 7 is joined with the header assembly 15, two grounding plates 3, 3 slide in the slot of the fork-shaped receptacle 11*a* of the grounding contact 11, and the male-type contacting tip 13*a* is inserted in the connector 17 where it makes electrical contact with the center contact (not shown in the drawing) connected to the center wire of the coaxial cable 19. This results in electrical connection between the grounding plates 3 and the grounding contacts 11 and between the center contact (not shown in the drawing) of the connector 17 and the signal contact 13. The connecting portions 11*b* and 13*b* of the grounding contacts 11, and the signal contacts of the header assembly 15, are inserted in and fixed to the mother board (not shown in the drawing), and the plug assembly 7 is joined with the header assembly 15. The connectors 17 terminating the coaxial cables 19 are inserted in the plug assembly 7 thereby making it possible to transmit the signal carried by the coaxial cable 19 to the mother board.

Here, the grounding contacts 11 and the signal contacts 13 of the header assembly 15, except for their connecting portions, are made in a roughly flat configuration of a strip line parallel to each other. This is made in order to equalize the impedance of the contacts 11, 13 with the impedance of the coaxial cable 19. This makes it possible to match the impedance between the coaxial cable 19 and the connecting portions 11*b*, 13*b* connected to the electronic elements on the mother board.

The plug assembly according to this invention described above provides for an easy assembly operation since the roughly flat grounding plates are contained in the plug housing. The assembly of the connector according to this invention is also easy, because the roughly flat grounding contacts are contained in the header housing, and the assembly is completed by a simple joining-together of the header assembly and the plug assembly.

An additional advantage of this invention consists in the fact that the grounding contacts and the grounding plates used in the device according to this invention have roughly flat configuration and are simple to produce.

I claim:

1. An electrical connector for coaxial cables comprising:

a plug assembly including a plug housing, said housing including holes for receipt of said coaxial cables therein, a cover housing with cable receiving holes, and grounding plates disposed in said plug housing for contact with an outer conductor of said coaxial cables; and a header assembly including a header housing, said header housing including signal contacts for electrically connecting with a center contact of the coaxial cable and fork-shaped ground contacts for connecting with the grounding plates, the ground contacts being alternated with said signal contact in said header housing.

2. An electrical connector as claimed in claim 1, wherein said grounding plates are inserted between connecting portions of said fork-shaped ground contacts upon insertion of said plug assembly into said header assembly.

3. An electrical connector as claimed in claim 1, wherein said grounding plates include contact blades and said outer conductor includes recesses so that said contact blades snap into said recesses on the outer conductor and secure the outer conductor in the plug assembly.

4. The electrical connector of claim 1, wherein said cover housing includes latching arms, and said header housing includes latching shoulders for engagement with said latching arms for forming said plug assembly.

5. The electrical connector of claim 1, wherein said plug housing includes slots which receive said fork-shaped contacts when said plug and header housings are mated.

6. An electrical connector as claimed in claim 1, wherein said cover housing includes means for locking said cover housing in position over said plug housing.

7. An electrical connector as claimed in claim 6, wherein said cover housing includes means for holding said grounding plates in position in said plug housing.

8. An electrical connector as claimed in claim 7, wherein said grounding plates are inserted between connecting portions of said fork-shaped ground contacts upon insertion of said plug assembly into said header assembly.

9. The electrical connector of claim 1, wherein said cover housing includes a pair of protruding ledges for retaining said ground plates.

10. The electrical connector of claim 9, wherein the cover housing further includes at least one central projection, disposed adjacent to said ledges, for supporting said grounding plates.

11. An electrical connector assembly for connection of coaxial cables to electrical contacts of a header comprising:

a plug connector including a plug housing, said housing including passageways for receipt of coaxial cables connected to coaxial cable connectors therein, and grounding plates disposed in said housing for contact with outer conductors of said coaxial cable connectors; and a header connector including a header housing, said header housing including signal contacts for electrically connecting with center contacts of the coaxial cable connectors and ground contacts including fork-shaped contacts for connecting with the grounding plates by insertion of the grounding plates into the fork-shaped contacts when the plug connector and header connector are mated.

12. An electrical connector assembly as claimed in claim 11, wherein said grounding plates include contact blades and said outer conductor includes recesses so that said contact blades snap into said recesses on the outer conductor and secure the coaxial cable connectors in the plug connector.

13. An electrical connector assembly as claimed in claim 11, wherein said plug connector further includes a cover housing with cable receiving holes and means for latching said cover housing in position onto said plug housing.

14. An electrical connector assembly as claimed in claim 13, wherein said cover housing holds said grounding plates in position in said plug housing.

15. The electrical connector assembly of claim 13, wherein said latching means include latching arms on said cover housing, and said header housing includes latching shoulders for engagement with said latching arms.

16. The electrical connector assembly of claim 13, wherein said cover housing includes a pair of protruding ledges for retaining said ground plates.

17. The electrical connector assembly of claim 16, wherein the cover housing further includes at least on central projection disposed adjacent to said ledges, for supporting said grounding plates.

18. The electrical connector assembly of claim 11, wherein said plug housing includes slots which receive said fork-shaped contacts when said plug and header connectors are mated.

* * * * *